US011176799B2

(12) United States Patent
Thompson et al.

(10) Patent No.: US 11,176,799 B2
(45) Date of Patent: Nov. 16, 2021

(54) GLOBAL POSITIONING SYSTEM EQUIPPED WITH HAZARD DETECTOR AND A SYSTEM FOR PROVIDING HAZARD ALERTS THEREBY

(71) Applicants: Jonathan Thompson, Los Angeles, CA (US); Latonya Slack, Los Angeles, CA (US)

(72) Inventors: Jonathan Thompson, Los Angeles, CA (US); Latonya Slack, Los Angeles, CA (US)

( * ) Notice: Subject to any disclaimer, the term of this patent is extended or adjusted under 35 U.S.C. 154(b) by 0 days.

(21) Appl. No.: 16/565,918

(22) Filed: Sep. 10, 2019

(65) Prior Publication Data

US 2021/0074141 A1 Mar. 11, 2021

(51) Int. Cl.

| | |
|---|---|
| ***G08B 21/10*** | (2006.01) |
| ***G08B 17/10*** | (2006.01) |
| ***G08B 21/14*** | (2006.01) |
| ***G08B 7/06*** | (2006.01) |

(52) U.S. Cl.

CPC ..... *G08B 21/10* (2013.01); *G08B 7/06* (2013.01); *G08B 17/10* (2013.01); *G08B 21/14* (2013.01)

(58) Field of Classification Search

None

See application file for complete search history.

(56) References Cited

U.S. PATENT DOCUMENTS

| | | | | |
|---|---|---|---|---|
| 5,461,365 | A | 10/1995 | Schlager et al. | |
| 5,628,050 | A * | 5/1997 | McGraw | G08B 27/001 340/7.5 |
| 5,650,770 | A | 7/1997 | Schlager et al. | |
| 6,028,514 | A | 2/2000 | Lemelson et al. | |
| 6,031,455 | A | 2/2000 | Grube | |
| 6,295,001 | B1 * | 9/2001 | Barber | G08B 21/10 340/601 |
| 6,351,218 | B1 * | 2/2002 | Smith | G01W 1/02 340/601 |
| 6,463,273 | B1 * | 10/2002 | Day | G08B 27/003 340/539.28 |
| 6,552,647 | B1 | 4/2003 | Thiessen et al. | |
| 6,747,557 | B1 * | 6/2004 | Petite | G05B 19/042 340/286.05 |
| 7,027,808 | B2 | 4/2006 | Wesby | |
| 7,301,455 | B2 | 11/2007 | McKenna et al. | |
| 8,624,771 | B2 | 1/2014 | Kuhn | |
| 8,830,057 | B1 | 9/2014 | Poursohi et al. | |
| 9,251,687 | B2 | 2/2016 | Thompson | |

(Continued)

*Primary Examiner* — Curtis J King

(57) ABSTRACT

A hazard detector system, comprising: hazard detectors communicatively connected to computing devices; a geolocation detector; an occupancy detector; a power source; an alert device; a secondary location detector; an interaction device. The hazard detectors may be configured to transmit information related to a plurality of hazardous environmental conditions to and from the computing devices. The alert device may provide a perceptible alert to individuals in proximity to the hazard detectors. The geolocation detector may be configured to identify a geographic location of the hazard detector. The interaction device may provide the individuals in proximity of the hazard detector the ability to provide additional information about the hazardous environmental conditions to the computing devices.

11 Claims, 7 Drawing Sheets

(56) References Cited

U.S. PATENT DOCUMENTS 9,652,975 B1* 5/2017 Riley ..... G08B 25/009
9,721,457 B2 8/2017 Thompson
9,842,479 B1* 12/2017 Black ..... G08B 27/00
9,888,371 B1* 2/2018 Jacob ..... G08B 13/22
9,898,912 B1* 2/2018 Jordan, II ..... G05B 15/02
10,311,749 B1* 6/2019 Kypri ..... G06Q 40/00
2002/0080038 A1* 6/2002 Smith ..... G01W 1/02 340/601
2003/0234725 A1 12/2003 Lemelson
2004/0181340 A1* 9/2004 Smith ..... G08B 21/10 702/3
2004/0183687 A1* 9/2004 Petite ..... G05B 19/4185 340/601
2004/0203568 A1 10/2004 Kirtland
2004/0263338 A1 12/2004 Katz
2005/0085257 A1* 4/2005 Laird ..... H04M 3/5116 455/550.1
2005/0162267 A1 7/2005 Khandelwal
2005/0166222 A1* 7/2005 Tully, Jr. ..... H04N 21/42221 725/33
2005/0197775 A1* 9/2005 Smith ..... G08B 27/006 702/3
2006/0015254 A1* 1/2006 Smith ..... H04W 4/024 702/3
2006/0058004 A1* 3/2006 Dolezal ..... H04W 76/50 455/404.1
2007/0008104 A1 1/2007 McBain
2007/0139183 A1 6/2007 Kates
2007/0194906 A1* 8/2007 Sink ..... G08B 17/10 340/506
2007/0287482 A1* 12/2007 Landsman ..... H04L 67/12 455/466
2008/0048873 A1* 2/2008 Araiza-Boys ..... G08B 3/10 340/601
2008/0122988 A1* 5/2008 Johnston ..... H04N 21/485 348/731
2008/0172352 A1* 7/2008 Friedlander ..... G06N 7/08 706/46
2008/0224856 A1* 9/2008 Verma ..... G08B 27/006 340/539.14
2009/0096620 A1* 4/2009 Kuo ..... G08B 17/10 340/628
2009/0170467 A1 7/2009 Nowlan et al.
2009/0219152 A1 9/2009 Angelo et al.
2009/0251312 A1 10/2009 Shelton et al.
2009/0316671 A1* 12/2009 Rolf ..... H04W 4/029 370/338
2009/0322523 A1 12/2009 McKenna et al.
2010/0020166 A1 1/2010 Levine et al.
2010/0240339 A1* 9/2010 Diamond ..... H04H 60/16 455/404.2
2011/0012753 A1 1/2011 Shrum, Jr.
2011/0212700 A1* 9/2011 Petite ..... H04W 4/12 455/404.1
2011/0241877 A1* 10/2011 Wedig ..... G08B 25/016 340/540
2012/0112901 A1* 5/2012 Chasko ..... G08B 21/10 340/517
2012/0194334 A1 8/2012 Worthington et al.
2012/0326889 A1 12/2012 Kabler et al.
2013/0241727 A1 9/2013 Coulombe
2013/0335550 A1 12/2013 Rochenski
2014/0031082 A1 1/2014 Zishaan
2014/0055272 A1* 2/2014 Mccormick ..... G08B 21/10 340/601
2015/0022357 A1* 1/2015 Gettings ..... G08B 3/00 340/568.1
2015/0189071 A1* 7/2015 Maxwell ..... H04M 11/045 455/414.1
2015/0302728 A1* 10/2015 Gettings ..... G08B 3/10 340/506
2015/0348400 A1* 12/2015 Zribi ..... G08B 29/185 340/506
2016/0027292 A1* 1/2016 Kerning ..... G08B 25/016 455/404.2
2016/0335879 A1* 11/2016 Carr ..... G16H 40/67
2017/0032651 A1* 2/2017 Eubanks ..... G01W 1/00
2017/0086050 A1* 3/2017 Kerning ..... H04W 4/90
2017/0099357 A1* 4/2017 Haupt ..... H04L 67/02
2017/0148241 A1* 5/2017 Kerning ..... G08B 27/006
2017/0154518 A1* 6/2017 Prabhakar ..... G08B 25/009
2018/0053401 A1* 2/2018 Martin ..... G08B 29/188
2018/0197402 A1* 7/2018 Zribi ..... G08B 7/06
2018/0211512 A1* 7/2018 Zribi ..... G08B 21/02
2018/0375887 A1* 12/2018 Dezent ..... H04L 63/1458
2019/0130719 A1* 5/2019 D'Amico ..... G06F 9/44
2019/0197876 A1* 6/2019 Mullins ..... G08B 25/016
2019/0228631 A1* 7/2019 Stinson ..... G06Q 10/06398
2020/0064433 A1* 2/2020 Finlay ..... H04B 1/385

* cited by examiner

GLOBAL POSITIONING SYSTEM EQUIPPED WITH HAZARD DETECTOR AND A SYSTEM FOR PROVIDING HAZARD ALERTS THEREBY

FIELD OF USE

The present disclosure relates to detectors of hazardous environmental conditions (e.g., smoke, gas, motion). Specifically, the disclosure relates to a hazard detector configured to transmit and/or receive information related to hazardous environmental conditions based at least in part on the location of the hazard detector as identified through one or more location-based service devices, systems, and/or methods (e.g., global positioning systems (GPS), cellular triangulation, Internet IP geolocation).

BACKGROUND

In many cases during a natural disaster, loss of life and bodily harm can be attributed to lack of appropriate early warning systems. With early detection and warning, individuals can prepare for impending disasters and take appropriate actions needed to mitigate loss of life and damage to property.

By and large, most individuals rely on emergency broadcast systems to receive early warning and reports of impending natural disasters or other hazardous environmental conditions. However, it is rare that an individual, or even a group of individuals, has constant access to such emergency broadcast systems. In general, these systems are provided over some form of electronic medium (e.g., television, radio, Internet), all of which must be active or otherwise engaged for the device to receive the emergency broadcast signal.

Further, because emergency broadcast systems are generally indiscriminate as to location, it may be hard for an individual to know whether they are in danger with regards to any specific emergency broadcast. For instance, an emergency broadcast could be sent out over all available mediums (e.g., television, radio, Internet) for an emergency that only affects or potentially affects a portion of the communities served by the emergency broadcast. In this example, public panic could be caused in areas not affected by the current or pending hazard.

Additionally, all emergency broadcast systems are currently based on the concept of a central broadcasting system receiving an alert from a single source (e.g., government agency) and then broadcasting that alert to everyone in a listening/viewing area. The recipient of the broadcast has no ability to interact with the alert system nor does it have the ability to provide real-time updates as to whether the broadcast is relevant to the specific area of the recipient or whether the recipient needs additional support (e.g., medical, fire, rescue) in response to the emergency. Additionally, the recipient may need additional support from medical, fire, and/or rescue, but may not have a way of communicating with additional support. In addition, medical, fire, and/or rescue may desire to confirm the occupancy or vacancy of a location, but do not possess a way of verifying occupancy.

Therefore, there is a need in the art for a hazard detector to verify the occupancy of individual(s) in possession of, or in the vicinity of, the hazard detector(s). These and other features and advantages of the present disclosure will be explained and will become obvious to one skilled in the art through the summary of the systems and methods of the present disclosure that follows.

SUMMARY OF EMBODIMENTS

The present disclosure may be a hazard detection and alert device capable of alerting individuals of impending dangers based on their specific location. In a preferred embodiment, the hazard detector may be configured to provide alerts to homeowners or other individuals in possession of the hazard detector using location-based systems in order to verify accuracy and applicability of specific hazard reports.

According to an embodiment of the present disclosure, a hazard detector may comprise: a geolocation device configured to identify a geographic location of the hazard detector; a communication mechanism configured to transmit the geographic location of the hazard detector and receive hazard alerts from a remote hazard detection and alert system; and an alert mechanism configured to provide a perceptible alert to individuals in the proximity of the hazard detector.

According to an embodiment of the present disclosure, the geolocation mechanism may be a global positioning system.

According to an embodiment of the present disclosure, the geolocation mechanism may be a cellular positioning system.

According to an embodiment of the present disclosure, the alert mechanism may be one or more alert systems and/or devices selected from the group comprising, speakers, video displays, LEDs, warning lights, strobe lights, force feedback devices, electro stimulation devices and tone generators.

According to an embodiment of the present disclosure, the communications mechanism may be selected from the group of devices and systems comprising a satellite communications system, a cellular communications system, and a wired communications system.

According to an embodiment of the present disclosure, the hazard detector may comprise one or more power sources selected from the group comprising an AC power source, a DC power source, a battery powered power source, and a solar power source.

According to an embodiment of the present disclosure, the hazard detector comprises a hazard detection mechanism configured to detect the presence of one or more types of hazards.

According to an embodiment of the present disclosure, the hazard detection mechanism may be selected from the group comprising a smoke detector, a carbon monoxide detector, a heat detector, a motion sensor, a video camera, a glass break sensor, a microphone, a Geiger counter and a water sensor.

According to an embodiment of the present disclosure, the communications mechanism may be further configured to transmit information about a detected hazard to said remote hazard detection and alert system.

According to an embodiment of the present disclosure, a method for providing hazard detection may comprise the steps of: receiving a hazard alert at a remote hazard detection and alert system; identifying a geographic location of said hazard alert; retrieving a list comprising identifiers for one or more hazard detectors in said geographic location; and transmitting an alert to said one or more hazard detectors, based at least in part on said hazard alert.

According to an embodiment of the present disclosure, the hazard alert may be received from a third party alert system.

According to an embodiment of the present disclosure, the hazard alert may be received from a first hazard detector.

According to an embodiment of the present disclosure, the geographic location comprises a geographic area impacted by said hazard alert.

According to an embodiment of the present disclosure, the method further may comprise the step of generating alerts at each of said one or more hazard detectors.

According to an embodiment of the present disclosure, the method further may comprise the step of verifying the occupancy of individual(s) in possession of, or in the vicinity of, the hazard detector(s).

According to an embodiment of the present disclosure, the method further may comprise the step of sensing and detecting the occupancy of individual(s) in possession of, or in the vicinity of, the hazard detector(s).

According to an embodiment of the present disclosure, the method further may comprise the step of notifying medical, fire, and/or rescue mechanisms and/or systems of the building occupancy of individual(s) in possession of, or in the vicinity of, the hazard detector(s) before, during, and/or after a hazard alert(s).

According to an embodiment of the present disclosure, the alerts are perceptible to individuals in the proximity of the one or more hazard detectors According to an embodiment of the present disclosure, the method may comprise the step of receiving a response from one or more of said one or more hazard detectors at said remote hazard detection and alert system.

According to an embodiment of the present disclosure, the response may be notifying of the occupancy of individual(s) in possession of, or in the vicinity of, a hazard detector.

According to an embodiment of the present disclosure, the response may be a request for emergency assistance.

The hazard detector system may further comprise at least one visually perceptible alert mechanism and/or at least one audibly perceptible alert mechanism configured to provide alerts in sequence(s) to inform the individual(s) in the proximity of the type, nature, and/or severity of present and/or impending hazardous environmental condition(s).

The hazard detector system may comprise an alert mechanism that comprises at least one visually perceptible alert mechanism of different color(s), sequences, and luminous intensity based on said hazard alert type, nature, and/or severity of the hazardous environmental condition(s) and/or at least one audibly perceptible alert mechanism of varying decibel intensity based on said hazard alert type, nature, and/or severity of present and/or impending hazardous environmental condition(s).

The foregoing summary of the present disclosure with the preferred embodiments should not be construed to limit the scope of the disclosure. It should be understood and obvious to one skilled in the art that the embodiments of the disclosure thus described may be further modified without departing from the spirit and scope of the disclosure.

These, as well as other components, steps, features, objects, benefits, and advantages, will now become clear from a review of the following detailed description of illustrative embodiments, of the accompanying photographs, and of the claims.

BRIEF DESCRIPTION OF THE DRAWINGS

The drawings show illustrative embodiments, but do not depict all embodiments. Other embodiments may be used in addition to or instead of the illustrative embodiments. Details that may be apparent or unnecessary may be omitted for the purpose of saving space or for more effective illustrations. Some embodiments may be practiced with additional components or steps and/or without some or all components or steps provided in the illustrations. When different drawings contain the same numeral, that numeral refers to the same or similar components or steps.

DETAILED DESCRIPTION OF ILLUSTRATIVE EMBODIMENTS

Figure 1:
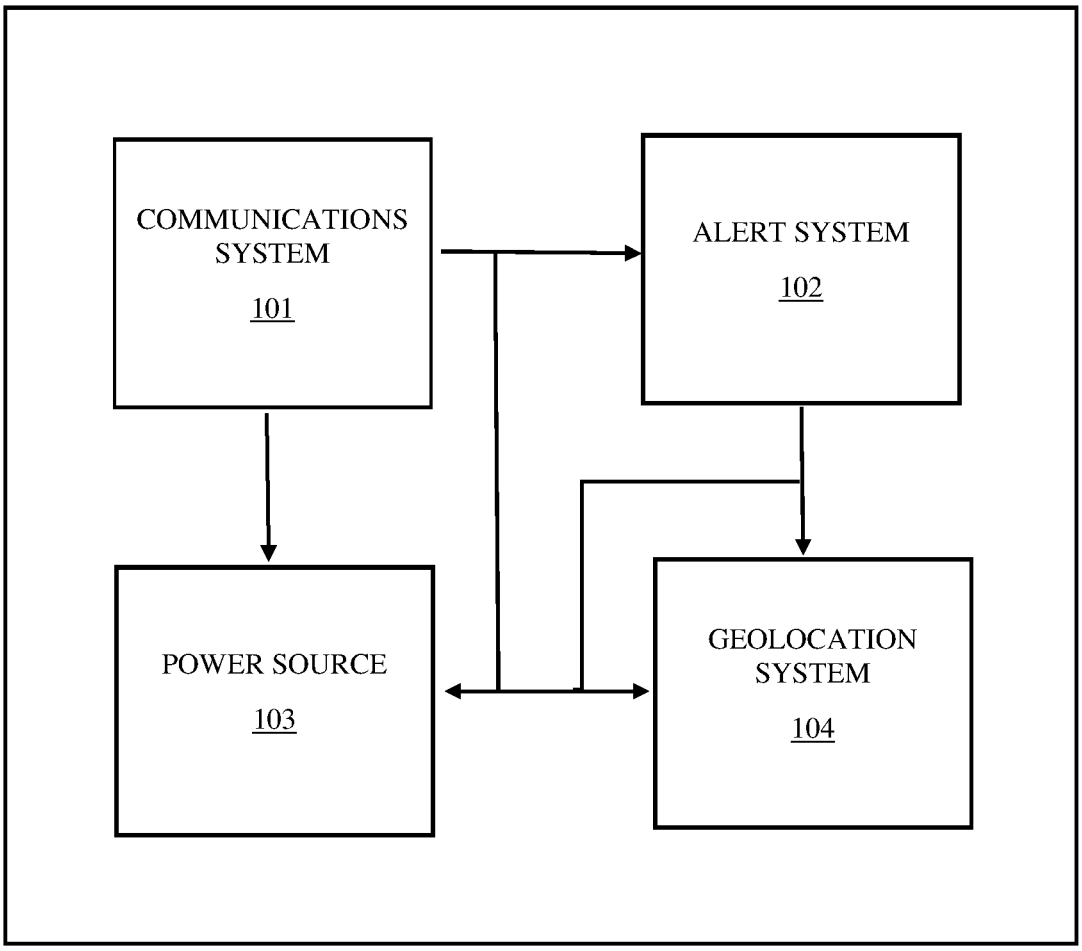
FIG. 1 is a diagram of a hazard detector in accordance with an embodiment of the present disclosure.

In the following detailed description of various embodiments, numerous specific details are set forth in order to provide a thorough understanding of various aspects of one or more embodiments. However, one or more embodiments may be practiced without some or all of these specific details. In other instances, well-known procedures and/or components have not been described in detail so as not to unnecessarily obscure aspects of the embodiments.

While some embodiments are disclosed here, still other embodiments will become obvious to those skilled in the art as a result of the following detailed description of the illustrative embodiments. The embodiments are capable of modifications of various obvious aspects, all without departing from the spirit and scope of the protection. The figures, and their detailed descriptions, are to be regarded as illustrative in nature and not restrictive. Also, the reference or non-reference to a particular embodiment shall not be interpreted to limit the scope of protection.

Definitions

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

The term "substantially" refers to the complete or nearly complete extent or degree of an action, characteristic, property, state, structure, item, or result. For example, in one embodiment, an object that is "substantially" located within a housing would mean that the object is either completely within a housing or nearly completely within a housing. The exact allowable degree of deviation from absolute completeness may in some cases depend on the specific context. However, generally speaking, the nearness of completion will be so as to have the same overall result as if absolute and total completion were obtained. The use of "substantially" is also equally applicable when used in a negative connotation to refer to the complete or near complete lack of an action, characteristic, property, state, structure, item or result.

As used herein, the terms "approximately" and "about" generally refer to a deviance of within 5% of the indicated number or range of numbers. In one embodiment, the term "approximately" and "about" may refer to a deviance of between 0.001-10% from the indicated number or range of numbers. Unless otherwise stated, all measurements, values, ratings, positions, magnitudes, sizes, locations, and other specifications that are set forth in this specification, including in the claims that follow, are approximate, not exact. They are intended to have a reasonable range that is consistent with the functions to which they relate and with what is customary in the art to which they pertain.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

In the following description, certain terminology is used to describe certain features of one or more embodiments. For instance, the terms "computer", "computer system", and "mobile computing device" generally refer to any apparatus or device that processes information with an integrated circuit chip, including without limitation, mainframe computers, workstations, gaming consoles, servers, desktop computers, portable computers, laptop computers, and embedded computers. Furthermore, the term "mobile computing device" may refer to any wireless electronic devices including smart phones, cellular phones, tablet computers, personal digital assistants, digital media players, portable game players, and hand-held computers.

As used herein, the terms "Internet" or "Cloud" generally refers to any collection of networks that utilizes standard protocols, whether Ethernet, Token ring, Wi-Fi, asynchronous transfer mode (ATM), Fiber Distributed Data Interface (FDDI), code division multiple access (CDMA), global systems for mobile communications (GSM), long term evolution (LTE), or any combination thereof.

As used herein, the terms "application", "software", "encryption application", or "software application" generally refer to any set of machine-readable instructions on a client machine, web interface, mobile computing device, and/or mobile computing device, that directs a processor to perform specific steps, processes, or operations disclosed herein.

As used herein, the term "geolocation" generally refers the process or technique of identifying the geographical location of a person or device via digital information processed via the Internet. Thus, geolocation-based encryption may refer to technology that utilizes a user's location when using the Internet or a mobile phone. The term "geolocation data" may refer to data that is utilized for locating a user, including without limitation, network router list data, global positioning satellite data, internet protocol address data, gyroscope data, and an accelerometer data. The term "network router list data" may refer to any data or information pertaining to the existing routers at an actual, physical location of a user.

The present disclosure relates to detectors of hazardous environmental conditions (e.g., smoke, gas, motion). Specifically, the disclosure relates to a hazard detector configured to transmit and/or receive information related to hazardous environmental conditions based at least in part on the location of the hazard detector as identified through one or more location based service mechanism (e.g., global positioning systems (GPS), cellular triangulation, Internet IP geolocation).

According to preferred embodiments of the present disclosure, the hazard detector of the present disclosure may be connected wirelessly to one or more remote computing devices for the provision of certain services related to the detection of hazards and alerting individuals to such hazards. As well as verifying and alerting the occupancy of individual(s) in possession of, or in the vicinity of, hazard detectors and communicating for the request of services. Wireless communication mechanism utilized with embodiments of the present disclosure may include, but are not limited to, satellite communication systems, cellular communication systems (e.g., 3G, 4G, LTE, CDMA, GSM), wireless Internet communications systems (e.g., WIFI). One of ordinary skill in the art would appreciate that there are numerous types of wireless communications systems that could be utilized with embodiments of the present disclosure, and embodiments of the present disclosure are contemplated for use with any form of wireless communications systems. Further, in certain embodiments, wired communications systems, such as Ethernet cables, telephone cables, CAT 5E, CAT 6 or any combination thereof, may be utilized in conjunction with or in lieu of one or more wireless communications systems. One of ordinary skill in the art would appreciate that there are numerous wired communications systems and combinations of wireless and wired communications systems that could be utilized with embodiments of the present disclosure, and embodiments of the present disclosure are contemplated for use with any communication systems.

One of ordinary skill in the art would appreciate that computing device appropriate for use with embodiments of the present application may generally be comprised of one or more of a Central processing Unit (CPU), Random Access Memory (RAM), and a storage medium (e.g., hard disk drive, solid state drive, flash memory, cloud storage). Examples of computing devices usable with embodiments of the present disclosure include, but are not limited to, personal computers, smart phones, laptops, mobile computing devices, tablet PCs and servers. The term computing device may also describe two or more computing devices communicatively linked in a manner as to distribute and share one or more resources, such as clustered computing devices and server banks/farms. One of ordinary skill in the art would understand that any number of computing devices could be used, and embodiments of the present disclosure are contemplated for use with any computing device.

In an exemplary embodiment according to the present disclosure, data may be provided to the system, stored by the system and provided by the system to users of the system across local area networks (LANs) (e.g., office networks, home networks) or wide area networks (WANs) (e.g., the Internet). In accordance with the previous embodiment, the system may be comprised of numerous servers communicatively connected across one or more LANs and/or WANs and configured to transmit and/or receive information from one or more hazard detectors communicatively connected to the servers. One of ordinary skill in the art would appreciate that there are numerous manners in which the system could be configured and embodiments of the present disclosure are contemplated for use with any configuration.

Turning now to FIG. 1, an exemplary embodiment of a hazard detector is shown. In this embodiment, a hazard detector may be comprised of a communications system 101, an alert system 102, a power source 103 and a geolocation system 104. In this embodiment, the hazard detector may be configured to receive hazard alerts from a remote computing system based on the location of the hazard detector as noted by its internal geolocation system 104. In certain embodiments, the hazard detector may be configured to receive alerts from the system and determine whether an alert applies to the particular hazard detector based on the location of the hazard detector as determined by the geolocation system 104. In other embodiments, the hazard detector may be configured to transmit its location (as determined by the geolocation system 104) to a remote computing system and the remote computing system will then transmit alerts to the hazard detector based on the provided location.

According to an embodiment of the present disclosure, the communications system 101 of the hazard detector may be any wireless communication system, wired communications system, or any combination thereof (as noted above). In some embodiments of the present disclosure, the communications system 101 of the hazard detector may be configured to only receive data communications from a remote computing system. In these embodiments, processing of the information associated with the data received will be handled in the hazard detector. In preferred embodiments of the present disclosure, the communications system 101 may be configured to transmit and receive data from the remote computing system. In these embodiments, processing of the information associated with the data may be performed on the remote computing system, on the hazard detector, or any combination thereof.

According to an embodiment of the present disclosure, the alert system 102 of the hazard detector may be comprised of one or more components configured to provide perceptible alerts to one or more individuals. Alert systems may include, but are not limited to, audible indicators, visual indicators, tactile indicators or any combination thereof. Audible indicators may include, but are not limited to, sirens, beep generators, voice playback devices or any combination thereof. Visual indicators may include, but are not limited to, strobe lights, flashing lights, LEDs, flood lights, display screens, solid display lights, illumination devices, or any combination thereof. Tactile indicators may include, but are not limited to force feedback devices, electro-stimulation devices and other tactile sensory stimulation devices. A hazard detector may include one or more types of alert systems. One of ordinary skill in the art would appreciate that there are numerous types of alert systems and combinations of alert systems that could be utilized with embodiments of the present disclosure, and embodiments of the present disclosure are contemplated for use with any type of alert systems or combination of alert systems.

According to an embodiment of the present disclosure, the power source 103 of the hazard detector may include, but are not limited to batteries, AC power supplies, DC power supplies, rechargeable power systems (e.g., solar power panels with battery backup systems) or any combination thereof. One of ordinary skill in the art would appreciate that there are numerous types of power sources that could be utilized with embodiments of the present disclosure, and embodiments of the present disclosure are contemplated for use with any type of power source. In a preferred embodiment, the power source would comprise at least one source of power that may be self-contained (e.g., battery backup) so that if power transmission systems in the area are downed or otherwise disabled, the hazard detector can continue to operate on its own backup power.

According to an embodiment of the present disclosure, the geolocation system 104 of the hazard detector may be configured to identify the location of the hazard detector. Geolocation system 204 may include, but are not limited to, GPS systems, cellular location systems (e.g., triangulation), IP address geolocation systems, or any combination thereof. One of ordinary skill in the art would appreciate that there are numerous geolocation systems that could be utilized with embodiments of the present disclosure, and embodiments of the present disclosure are contemplated for use with any geolocation system. Further, certain embodiments of the present disclosure may include a plurality of geolocation systems. In this manner, if one form of geolocation system was unavailable (e.g., GPS unable to get signal) a secondary geolocation system could be utilized (e.g., IP address geolocation). Additionally, the geolocation system 104 may include secondary location components allowing for detailed location information, such as altitude and positioning (e.g., level, degree of tilt). One of ordinary skill in the art would appreciate that there are numerous types of secondary location components (e.g., accelerometer, levels, altimeters) that may be utilized with embodiments of the present disclosure, and embodiments of the present disclosure are contemplated for use with any such secondary location components.

Figure 2:
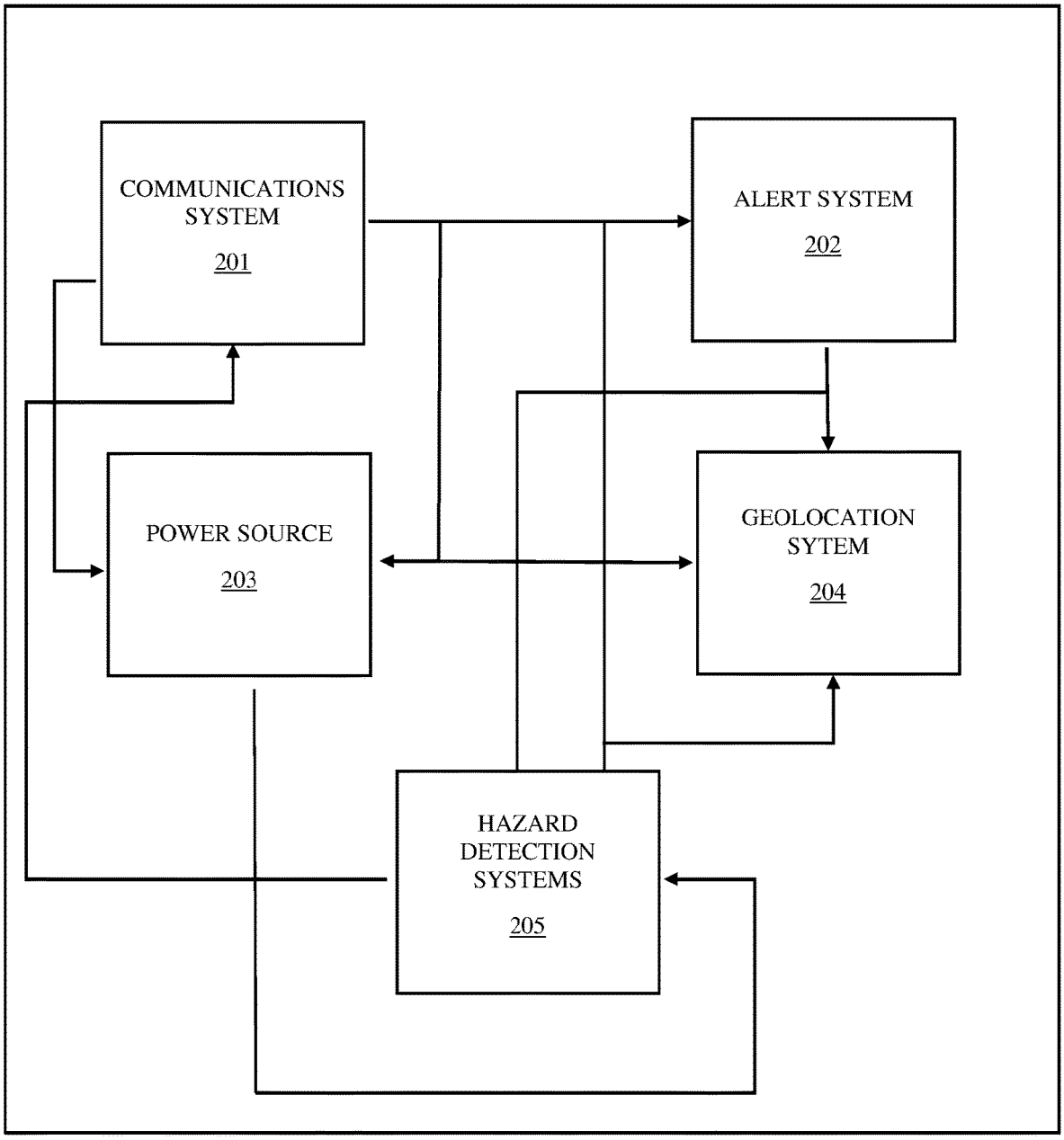
FIG. 2 is a diagram of a hazard detector with transmission capabilities in accordance with an embodiment of the present disclosure.

Turning now to FIG. 2 an exemplary embodiment of a hazard detector is shown. In this embodiment, a hazard detector may be comprised of a communications system 201, an alert system 202, a power source 203 a geolocation system 204 and a hazard detection system 205. The communications system 201, alert system 202, power source 203 and geolocation system 204 are similar in like and kind with those described above with respect to the embodiment shown in FIG. 1.

According to an embodiment of the present disclosure, the hazard detection system 205 of a hazard detector may be configured to detect one or more environment hazard or other type of hazard. Hazard detection system 205, may include, but is not limited to, one or more of a carbon monoxide detector, a smoke detector, a heat detector, a water detector, a motion detector, a glass break detector a video camera, an audio recording device or any combination thereof. One of ordinary skill in the art would appreciate that there are numerous types of hazard detection systems that could be utilized with embodiments of the present disclosure, and embodiments of the present disclosure are contemplated for use with any number and kind of hazard detection systems.

In embodiments of the present disclosure where the hazard detector may comprise a hazard detection system, the hazard detector may be configured to not only receive emergency alerts, but it may also be configured to detect local hazards. By detecting local hazards, the hazard detector may work in conjunction with the remote computing system to provide additional functionality. For instance, if there is an ongoing alert for a wildfire in the area of the hazard detector, and a hazard detection system on the hazard detector detects an increase in heat or the presence of smoke, the hazard detector could both confirm the presence of the hazard to individuals in the immediate vicinity, but could also provide information to the remote computing system about the veracity of the impending hazard. In embodiments where a voice audio playback alert or video alert mechanism may be provided, the hazard detector could alert the individuals in the immediate vicinity of the confirmation of a pending or present hazard and any associated information. For instance, information could be provided regarding appropriate escape routes, time until rescue, medical or other emergency personnel will arrive, or information about how to best mitigate harmful environmental effects (e.g., putting wet rags over mouth and nose in the presence of smoke).

In certain embodiments, the hazard detector can be fixed, such as installed on a home (e.g., similar to a smoke detector, alarm system, or thermostat). In other embodiments, the hazard detector may be portable. In still further embodiments, the hazard detector may be extremely portable or wearable on an individual (e.g., a watch, a badge, a handheld device).

In certain embodiments of the present disclosure, hazard detectors may be made from materials and/or components that are resistant to various elements. For instance, certain embodiments of the present disclosure may be made from water resistant or waterproof materials where the risk of water damage is present. Other embodiments may be made from materials with properties such as shock resistant, fire resistant, resistant to electromagnetic pulses, resistant to bending or twisting effects, etc. One of ordinary skill in the art would appreciate that there are numerous materials that a hazard detector could be built from and embodiments of the present disclosure are contemplated for use with any such materials.

In certain embodiments, the hazard detection system may be external from the hazard detector and may be communicatively connected to the hazard detector via one or more communications system (e.g., wired communications system, wireless communications system). In this manner, the hazard detector may be extendable with additional hazard sensors as required by the user or the specific implementation.

By allowing for a hazard detector that can not only detect local hazards, but also receive information about hazards in the area, individuals are provided with a safety device that increases the accuracy and reduces false positives when it comes to hazard alerts. Further, usage of embodiments of the present disclosure has the distinct advantage of providing constant access to emergency broadcast message, even when other devices would be powered off or otherwise not available.

Certain embodiments of the present disclosure may allow users or individuals near the hazard detector to communicate through the hazard detector with one or more remote hazard detection and alert systems. For instance, a hazard detector may have a built-in microphone for receiving voice commands from a user. In other embodiments, users may be able to connect to the hazard detector via wireless system (e.g., through a smartphone application or through a near field communication or Bluetooth connection system). In these embodiments, users have the ability to request help or otherwise provide more information about a hazard to the remote hazard detection and alert system. This may allow the remote hazard detection and alert system to contact the appropriate emergency personnel or issue a wider hazard alert for others in the immediate area.

Certain embodiments of the present disclosure may allow the user to interact with the hazard detector through a control interface connected to the hazard detector through one or more wireless connections, through one or more wired connections or any combination thereof. Control interfaces can include, but are not limited to, proprietary control panels, smart interfaces associated with other systems (e.g., thermostat interface, security panel interface, computer interface). Control interfaces may allow for the user to interact with the system in numerous ways, including, but not limited to, reporting a hazard, disarming a sensor, adding a sensor, removing a sensor, requesting aid (e.g., fire, rescue, medical), checking system status, checking power status (e.g., battery levels) or any combination thereof. One of ordinary skill in the art would appreciate that there are numerous types of interactions the system could provide to the user via a control interface, and embodiments of the present disclosure are contemplated for use with any type of interaction. Installation of the control interface could be anywhere that the control interface could be in communicatively connected to the hazard detector and usable by the user when required. Control interfaces may be interacted with via one or more interaction mechanism, including, but not limited to, touchscreens, keyboards, buttons, optical devices, voice recognition devices, switches, sliders or any combination thereof. One of ordinary skill in the art would appreciate that there are numerous interaction mechanisms that could be utilized with embodiments of the present disclosure and embodiments of the present disclosure are contemplated for use with any interaction device or system.

Figure 3:
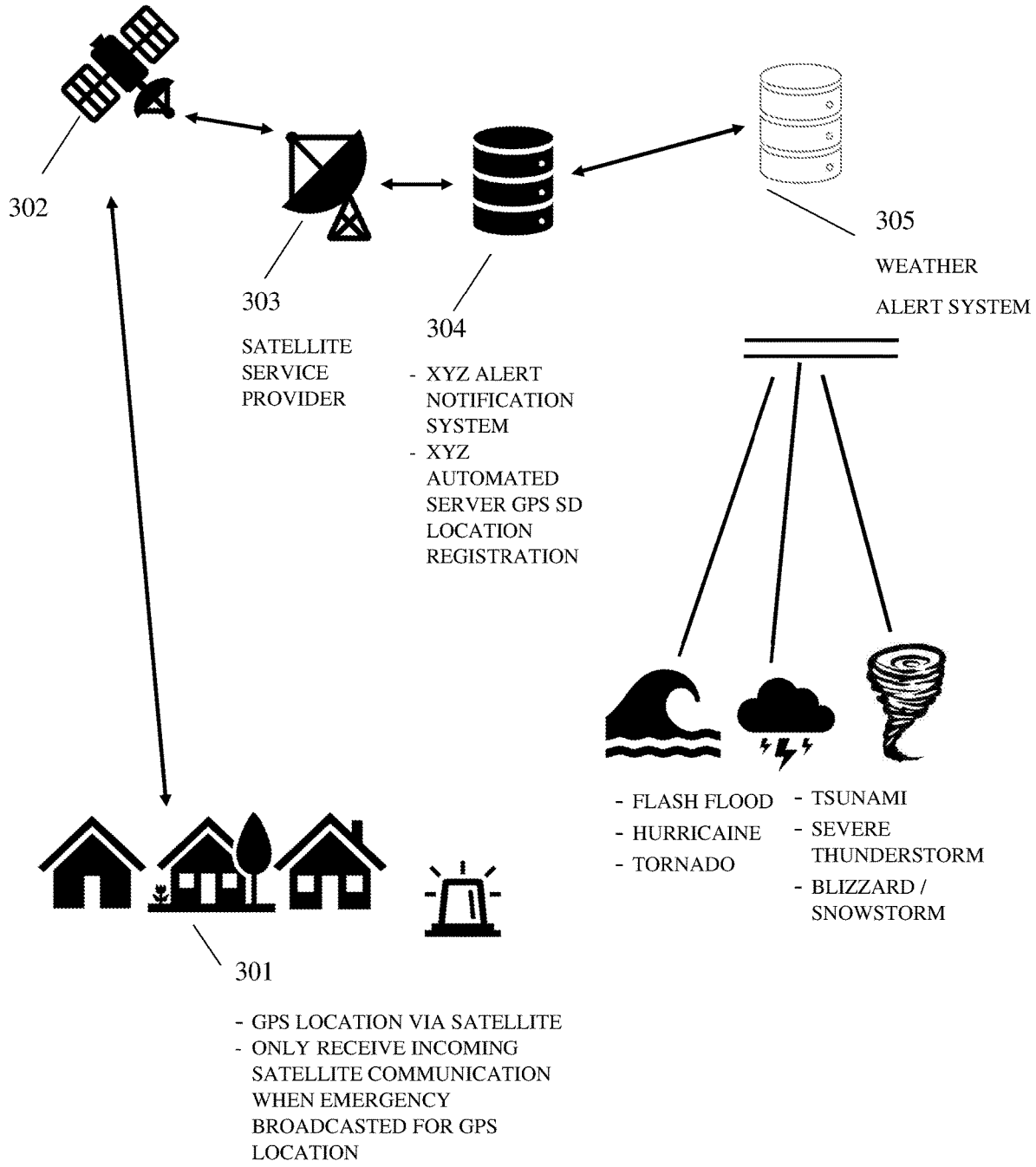
FIG. 3 is an overview of a system in accordance with an embodiment of the present disclosure.

Turning now to FIG. 3, an overview of a system in accordance with an embodiment of the present disclosure is shown. In this system diagram, one or more hazard detectors 301 communicate with a remote hazard detection and alert system 304 via a wireless communications system 302/303 (in this case a satellite communication system). The remote hazard detection and alert system 304 may be communicatively connected with a third party alert system 305 (in this case a weather alert system, like NOAA).

According to an embodiment of the present disclosure, the remote hazard detection and alert system 304 may be configured to receive and transmit hazard information 304 to one or more hazard detectors 301 based on a location identified by each of the hazard detectors 301. The actual hazard alerts may be formulated or drawn from one or more sources. In a preferred embodiment, the remote hazard detection and alert system 304 will pull alert information from a third-party system 305, generally from an application programming interface (API) or other information transmission service that is generally available. In other embodiments, the remote hazard detection and alert system 304 may generate its own alerts based on information collected from one or more hazard detectors 301. For instance, if numerous hazard detectors 301 in a specific geographic area are sending similar hazard identification information (e.g., smoke, heat), the remote hazard detection and alert system 304 could send alerts to all hazard detectors 301 in the immediate geographic location where the other hazard detectors sense the danger.

Figure 4:
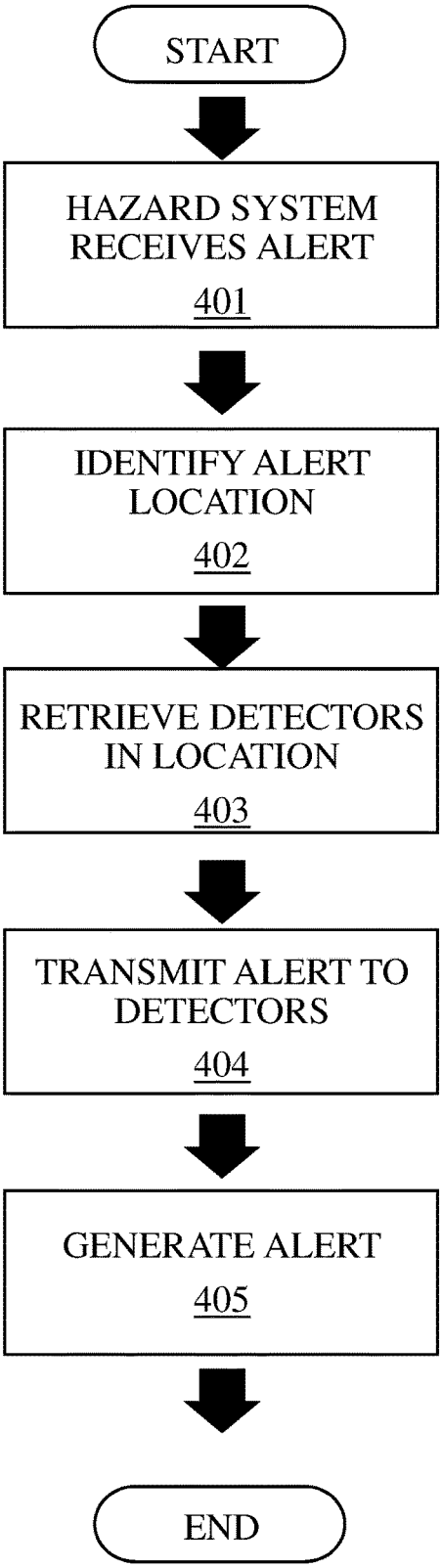
FIG. 4 is a process flow diagram for providing hazard alerts, in accordance with an embodiment of the present disclosure.

Turning now to FIG. 4, an exemplary method for providing hazard system alerts to one or more hazard detectors, in accordance with an embodiment of the present disclosure, is shown. The process starts at step 401 whereby a remote hazard detection and alert system receives a hazard alert from a third party alert system. In certain embodiments, the remote hazard detection and alert system may be configured to continually poll for hazard alerts of one or more types. In other embodiments, the remote hazard detection and alert system may be configured to receive hazard alerts from the third party alert system in a push manner (e.g., remote hazard detection and alert system automatically receives a communication from the third party alert system).

At step 402, the remote hazard detection and alert system parses the various information points received from the third party alert system, including geographic location of the alert, type of alert, impact area of the alert and severity of the alert as well as any secondary information associated with the alert. The remote hazard detection and alert system specifically details the area affected by the alert so that boundaries of which hazard detectors need to be contacted in response to a given alert.

At step 403, the remote hazard detection and alert system retrieves a list of one or more hazard detectors from a database or other data store. The list comprises only those hazard detectors either in the area or path of a given alert or those so proximately close to the area or path that either the direct impact of the hazard could cause repercussions on those outside the area or path or the hazard may have secondary effects that warrant alerting those outside the area or path of the hazard. For instance, an explosion of a nuclear reactor may have a direct blast, explosion and/or fire risk for a given area, but a secondary area may also be in risk of fallout or other secondary hazard concerns.

At step 404, the remote hazard detection and alert system sends the appropriate alerts to those hazard detectors identified in the list generated in the previous step. Alerts may vary on the type of hazard detector receiving the alert. For instance, a simple embodiment may only have an audible alert system, allowing the hazard detector to beep loudly in response to the receipt of an alert. In a more complex embodiment, the audible alert system may be comprised of an audible alert mechanism capable of playing an alert message and alert information.

At step 405, each of the hazard detectors receiving the alerts utilize their respective alert systems to alert the individuals in the nearby area of the impending or present hazard. At this point, the process ends.

Figure 5:
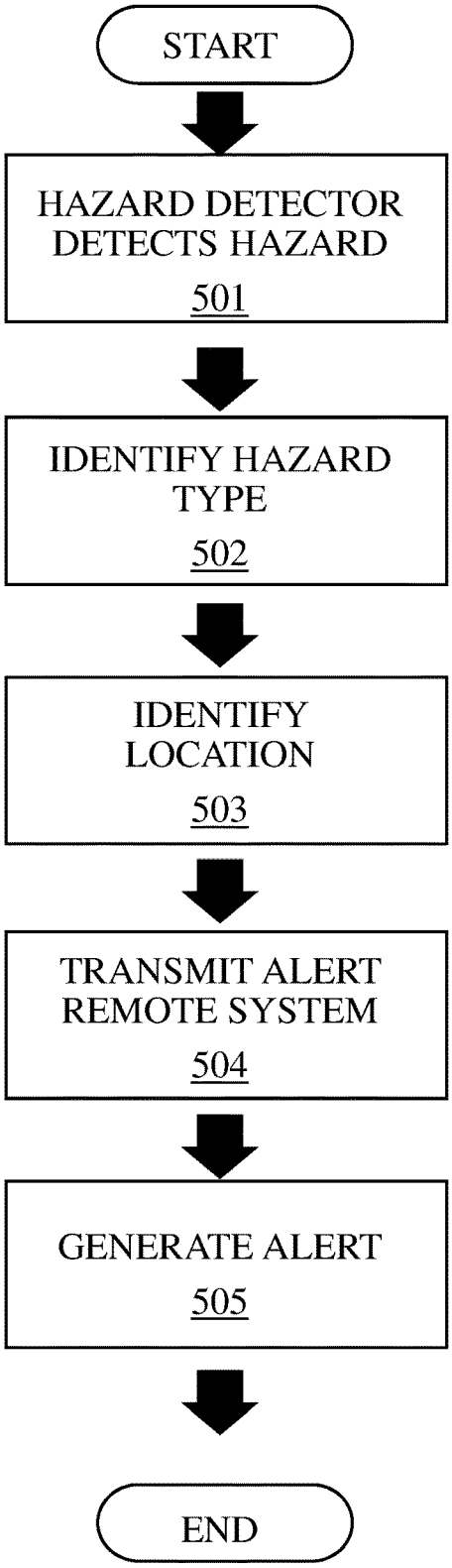
FIG. 5 is a process flow diagram for providing hazard reporting from a hazard detector, in accordance with an embodiment of the present disclosure.

Turning now to FIG. 5, an exemplary method for providing hazard reporting from a hazard detector, in accordance with an embodiment of the present disclosure, is shown. The process starts at step 501 whereby one or more hazard detectors detect the presence of a hazard via one or more hazard detection systems. The more hazard detection systems alerted, the greater level of information about the hazard could be identified. For instance, if a smoke detection is set off, it would provide hints at a nearby fire, but a smoke detection system and a heat detection system are both set off, the likelihood of a fire in the area is shown with greater certainty.

At step 502, the hazard detector identifies what kind of hazard is in the area by accumulating data from any and all hazard detection systems that have been tripped or otherwise alerted to the presence of a hazard. In certain embodiments, hazard detection systems that were not set off may be turned on to record or test for other hazards. For instance, a hazard detector that has a smoke sensor alerted to the presence of smoke may turn on an attached camera to record visual information that may be later processed by either the hazard detector or a remote hazard detection and alert system.

At step 503, the hazard detector may confirm its present location. In some cases, this step may be skipped where the hazard detector is known to be immobile or otherwise preprogrammed for a specific location. In certain embodiments, if the hazard detector cannot identify its location, it may use a last known location as its location. This helps to prevent loss of signal with its geolocation system disabling the ability of the hazard detector from reporting the hazard.

At step 504, The hazard detector transmits the alert information to a remote hazard detection and alert system for processing. The remote hazard detection and alert system takes the alert information and takes appropriate action with respect to the type and severity of alert. Actions may include contacting the appropriate response personnel (e.g., medical, rescue, fire, police), contacting specified individuals (e.g., home owner, parent, guardian), and/or contacting a third party alert system (e.g., NOAA) to report a potential hazard. In cases where numerous hazard detectors report alerts of the same type or similar or related types, the remote hazard detection and alert system may also generate an alert and push the alert to other hazard detectors in the general area.

At step 505, the hazard detector may generate a local alert for individuals in the area. At this point, the process ends.

Figure 6:
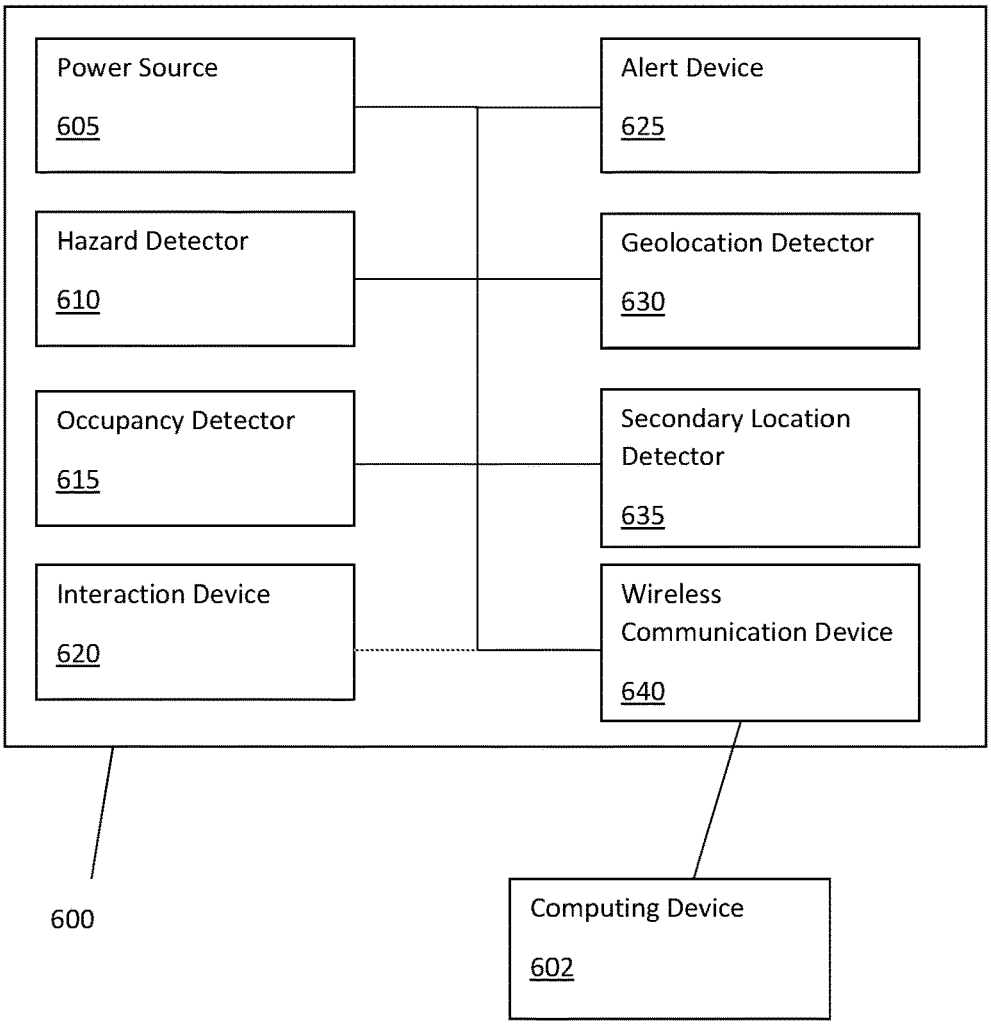
FIG. 6 is a block diagram of one embodiment of the hazard detector system.

FIG. 6 is a block diagram of one embodiment of the hazard detector system. As shown in FIG. 6, the hazard detector system may comprise a central hazard detection unit 600 and one or more computing devices 602. The one or more computing devices 602 may include, or be in communication with, substantially any hazardous environmental condition monitoring system, such as the Federal Emergency Alert System, National Weather Service, and NOAA Weather Radio All Hazards network.

The central hazard detection unit 600 may comprise a hazard detector 610, geolocation detector 630, occupancy detector 615, power source 605, alert device 625, secondary location detector 635, interaction device 620, and wireless communication device 640. The hazard detector 610 may comprise a smoke detector, a carbon monoxide detector, a heat detector, a water detector, a seismic detector and/or substantially any other environment monitoring device. The geolocation detector 630 may determine a location based on GPS coordinates. The occupancy detector 615 may comprise a radar detector, x-ray detector, heat detector, thermal imaging, motion detector, proximity detector, sonar, laser imaging, sound detector, and vibration detector, and/or anything else that may be used to determine occupancy of the surrounding area (i.e., the vicinity). In one embodiment, the occupancy detector 615 may be used to detect indirect evidence of occupancy, such as the presence of cell phones or other items commonly directly associated with an individual and kept on one's person at most times.

The power source 605 may be a battery, capacitor, ac power, dc power, or any other power source that may be usable. The alert device may comprise an audio output, video output, and/or anything else that may be used to provide information through the alert device. The secondary location detector 635 may include sensors that provide additional information not immediately available through the geolocation detector 630, such as altitude and gyroscopic related information. The interaction device 620 may comprise tactile buttons, keyboard, touchscreen, and/or any other mechanism for inputting information into an electronic device.

The wireless communication device 640 may allow the central hazard detection unit 600 to send and receive wireless signals, such as communications with said one or more computing devices 602.

In alternative embodiments, the various components of the central hazard detection unit 600 may be housed in separate devices or grouped together in substantially any combination.

Figure 7:
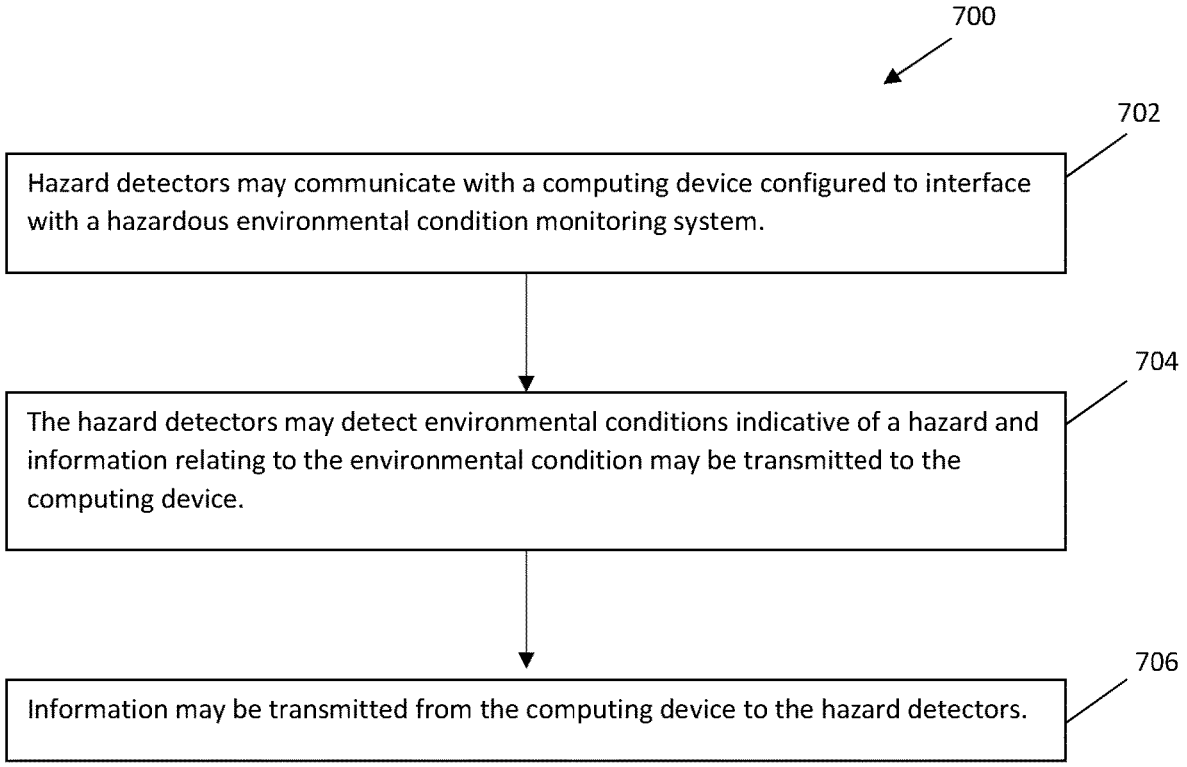
FIG. 7 is a process flow diagram for providing hazard reporting from a hazard detector, including providing relevant occupancy information.

FIG. 7 is a process flow diagram for providing hazard reporting based on a hazard detector system, including providing relevant occupancy information to response personnel 700. As shown in FIG. 7, the hazard detector system may identify a hazard through the use of various hazard detectors and facilitate the transfer of information.

First, hazard detectors may communicate with a computing device configured to interface with a hazardous environmental condition monitoring system 702. The computing device may also be in contact with local emergency services or other individuals and entities that may be in a position to assist.

Second, the hazard detectors may detect environmental conditions indicative of a hazard and information relating to the environmental condition may be transmitted to the computing device 704. Information relating to the environmental condition may include type of condition, severity of condition, and location of condition. Additionally, information regarding occupancy in the immediate proximity of the hazard detectors may be transmitted to the computing device.

Third, information may be transmitted from the computing device to the hazard detectors 706. This information transmitted may cause the alert device to provide audio or visual output that may be interpreted to provide additional information to individuals near the hazard detectors that may not be immediately apparent to the individuals, such as environmental conditions not in the individuals immediate proximity. This may provide the individual with valuable information to aid the individual in making decisions in difficult situations, including making a decision as to whether the individual should stay in place or move.

Throughout this disclosure and elsewhere, block diagrams and flowchart illustrations depict methods, apparatuses (i.e., systems), and computer program products. Each element of the block diagrams and flowchart illustrations, as well as each respective combination of elements in the block diagrams and flowchart illustrations, illustrates a function of the methods, apparatuses, and computer program products. Any and all such functions ("depicted functions") can be implemented by computer program instructions; by special-purpose, hardware-based computer systems; by combinations of special purpose hardware and computer instructions; by combinations of general purpose hardware and computer instructions; and so on—any and all of which may be generally referred to herein as a "circuit," "module," or "system."

While the foregoing drawings and description set forth functional aspects of the disclosed systems, no particular arrangement of software for implementing these functional aspects should be inferred from these descriptions unless explicitly stated or otherwise clear from the context.

Each element in flowchart illustrations may depict a step, or group of steps, of a computer-implemented method. Further, each step may contain one or more sub-steps. For the purpose of illustration, these steps (as well as any and all other steps identified and described above) are presented in order. It will be understood that an embodiment can contain an alternate order of the steps adapted to a particular application of a technique disclosed herein. All such variations and modifications are intended to fall within the scope of this disclosure. The depiction and description of steps in any particular order is not intended to exclude embodiments having the steps in a different order, unless required by a particular application, explicitly stated, or otherwise clear from the context.

Traditionally, a computer program consists of a finite sequence of computational instructions or program instructions. It will be appreciated that a programmable apparatus (i.e., computing device) can receive such a computer program and, by processing the computational instructions thereof, produce a further technical effect.

A programmable apparatus may comprise one or more microprocessors, microcontrollers, embedded microcontrollers, programmable digital signal processors, programmable devices, programmable gate arrays, programmable array logic, memory devices, application specific integrated circuits, or the like, which can be suitably employed or configured to process computer program instructions, execute computer logic, store computer data, and so on. Throughout this disclosure and elsewhere a computer can include any and all suitable combinations of at least one general purpose computer, special-purpose computer, programmable data processing apparatus, processor, processor architecture, and so on.

It will be understood that a computer can include a computer-readable storage medium and that this medium may be internal or external, removable and replaceable, or fixed. It will also be understood that a computer can include a Basic Input/Output System (BIOS), firmware, an operating system, a database, or the like that can include, interface with, or support the software and hardware described herein.

Embodiments of the system as described herein are not limited to applications involving conventional computer programs or programmable apparatuses that run them. It is contemplated, for example, that embodiments of the disclosure as claimed herein could include an optical computer, quantum computer, analog computer, or the like.

Regardless of the type of computer program or computer involved, a computer program can be loaded onto a computer to produce a particular machine that can perform any and all of the depicted functions. This particular machine provides a mechanism for carrying out any and all of the depicted functions.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

Computer program instructions can be stored in a computer-readable memory capable of directing a computer or other programmable data processing apparatus to function in a particular manner. The instructions stored in the computer-readable memory constitute an article of manufacture including computer-readable instructions for implementing any and all of the depicted functions.

A computer readable signal medium may include a propagated data signal with computer readable program code embodied therein, for example, in baseband or as part of a carrier wave. Such a propagated signal may take any of a variety of forms, including, but not limited to, electromagnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

The elements depicted in flowchart illustrations and block diagrams throughout the figures imply logical boundaries between the elements. However, according to software or hardware engineering practices, the depicted elements and the functions thereof may be implemented as parts of a monolithic software structure, as standalone software modules, or as modules that employ external routines, code, services, and so forth, or any combination of these. All such implementations are within the scope of the present disclosure.

In view of the foregoing, it will now be appreciated that elements of the block diagrams and flowchart illustrations support combinations of systems, devices, mechanisms, and methods for performing the specified functions, combinations of steps for performing the specified functions, program instruction systems for performing the specified functions, and so on.

It will be appreciated that computer program instructions may include computer executable code. A variety of languages for expressing computer program instructions are possible, including without limitation C, C++, Java, JavaScript, assembly language, Lisp, HTML, and so on. Such languages may include assembly languages, hardware description languages, database programming languages, functional programming languages, imperative programming languages, and so on. In some embodiments, computer program instructions can be stored, compiled, or interpreted to run on a computer, a programmable data processing apparatus, a heterogeneous combination of processors or processor architectures, and so on. Without limitation, embodiments of the system as described herein can take the form of web-based computer software, which may comprise client/server software, software-as-a-service, peer-to-peer software, or the like.

In some embodiments, a computer enables execution of computer program instructions including multiple programs or threads. The multiple programs or threads may be processed more or less simultaneously to enhance utilization of the processor and to facilitate substantially simultaneous functions. By way of implementation, any and all methods, program codes, program instructions, and the like described herein may be implemented in one or more thread. The thread can spawn other threads, which can themselves have assigned priorities associated with them. In some embodiments, a computer can process these threads based on priority or any other order based on instructions provided in the program code.

Unless explicitly stated or otherwise clear from the context, the verbs "execute" and "process" are used interchangeably to indicate execute, process, interpret, compile, assemble, link, load, any and all combinations of the foregoing, or the like. Therefore, embodiments that execute or process computer program instructions, computer-executable code, or the like can suitably act upon the instructions or code in any and all of the ways just described.

The functions and operations presented herein are not inherently related to any particular computer or other apparatus. Various general-purpose systems may also be used with programs in accordance with the teachings herein, or it may prove convenient to construct more specialized apparatus to perform the required method steps. The required structure for a variety of these systems will be apparent to those of skill in the art, along with equivalent variations. In addition, embodiments of the disclosure are not described with reference to any particular programming language. It is appreciated that a variety of programming languages may be used to implement the present teachings as described herein, and any references to specific languages are provided for disclosure of enablement and best mode of embodiments of the disclosure. Embodiments of the disclosure are well suited to a wide variety of computer network systems over numerous topologies. Within this field, the configuration and management of large networks include storage devices and computers that are communicatively coupled to dissimilar computers and storage devices over a network, such as the Internet.

While multiple embodiments are disclosed, still other embodiments of the present disclosure will become apparent to those skilled in the art from this detailed description. The disclosure is capable of myriad modifications in various obvious aspects, all without departing from the spirit and scope of the present disclosure. Accordingly, the drawings and descriptions are to be regarded as illustrative in nature and not restrictive.

The foregoing description of the preferred embodiment has been presented for the purposes of illustration and description. While multiple embodiments are disclosed, still other embodiments will become apparent to those skilled in the art from the above detailed description. The disclosed embodiments capable of modifications in various obvious aspects, all without departing from the spirit and scope of the protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope. It is intended that the scope or protection not be limited by this detailed description, but by the claims and the equivalents to the claims that are appended hereto.

Except as stated immediately above, nothing that has been stated or illustrated is intended or should be interpreted to cause a dedication of any component, step, feature, object, benefit, advantage, or equivalent, to the public, regardless of whether it is or is not recited in the claims.

What is claimed is:

1. A hazard detector system, comprising:

One or more hazard detectors communicatively connected to one or more computing devices;

a geolocation detector;

an occupancy detector;

a power source;

an alert device;

a secondary location detector;

an interaction device;

wherein said one or more hazard detectors are configured to transmit information related to a plurality of hazardous environmental conditions to and from said one or more computing devices, wherein said plurality of hazardous environmental conditions comprise smoke, carbon monoxide, heat, water, and seismic events;

wherein said alert device is configured to provide a perceptible alert to individuals in proximity to said one or more hazard detectors;

wherein said geolocation detector is configured to identify a geographic location of said one or more hazards detectors;

wherein said secondary location detector includes sensors that provide additional information not available through the geolocation detector, wherein said additional information includes altitude and gyroscopic related information, wherein said secondary location detector comprises one or more of: an accelerometer, a level device, an anemometer; and an altimeter;

wherein said interaction device provides said individuals in proximity of said one or more hazard detectors the ability to provide additional information about said plurality of hazardous environmental conditions to said one or more computing devices;

wherein at least one of said one or more computing devices is a hazard detection and alert system configured to receive a plurality of hazard information from and transmit said plurality of hazard information to one or more of said one or more hazard detectors based on a location of said one or more hazard detectors;

wherein a plurality of occupancy information generated by said occupancy detector is transmitted to said one or more computing devices;

wherein said hazard detection and alert system is configured to receive a plurality of environmental hazard information from a third-party system; and wherein said hazard detection and alert system transmits one or more electronic warning communication to said alert device, wherein a content of said one or more electronic warning communications is determined based on a type of said alert device and said plurality of occupancy information generated by said occupancy detector.

2. The hazard detector of claim 1, wherein said one or more hazard detectors, said geolocation detector, said occupancy detector, said power source, said alert device, said secondary location detector, and said interaction device are housed within a central hazard detection unit.

3. The hazard detector of claim 1, wherein said alert device is selected from the group consisting of one or more of: speakers, video displays, LEDs, warning lights, strobe lights, force feedback devices, electro stimulation devices, tone generators and combinations thereof.

4. The hazard detector of claim 1, wherein said power sources is selected from the group of power sources consisting of one or more of: an AC power source, a DC power source, a battery powered power source, a solar power source, and combinations thereof.

5. The hazard detector of claim 1, wherein said one or more hazard detectors are selected from the group of hazard detectors consisting of one or more of: a smoke detector, a carbon monoxide detector, a heat detector, a motion sensor, a video camera, a glass break sensor, a microphone, a seismic detector, a Geiger counter, a water sensor, and combination thereof.

6. The hazard detector system of claim 1, wherein said alert device utilizes at least one visually perceptible alert that is configured to provide visual alerts to inform said individuals about one or more of said plurality of hazardous environmental conditions.

7. The hazard detector system of claim 6, wherein said at least one visually perceptible alert comprises at least one of: different color(s), sequences, and luminous intensity.

8. The hazard detector system of claim 1, wherein said alert device utilizes at least one audibly perceptible alert that is configured to provide alerts to inform said individuals about one or more of said plurality of hazardous environmental conditions.

9. The hazard detector system of claim 8, wherein said at least one audibly perceptible alert is a sound of varying decibel intensity.

10. The hazard detector system of claim 1, wherein said occupancy detector comprises one or more of: radar detection, x-ray, heat detection, thermal imaging, motion detector, proximity detector, sonar, laser imaging, sound detector, and vibration detector.

11. The hazard detector system of claim 1, wherein said occupancy detector is selected from the group of occupancy detectors consisting of one or more of: radar detection, x-ray, heat detection, thermal imaging, motion detector, proximity detector, sonar, laser imaging, sound detector, vibration detector, and combinations thereof.

* * * * *